US010407845B1

(12) United States Patent
Downing

(10) Patent No.: US 10,407,845 B1
(45) Date of Patent: Sep. 10, 2019

(54) OSCILLATION ASSEMBLY FOR A PAVING MACHINE

(71) Applicant: Caterpillar Paving Products Inc., Brooklyn Park, MN (US)

(72) Inventor: Bryan Joseph Downing, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/108,201

(22) Filed: Aug. 22, 2018

(51) Int. Cl.
*E01C 19/48* (2006.01)
*E01C 19/23* (2006.01)
*E01C 19/43* (2006.01)

(52) U.S. Cl.
CPC ..... *E01C 19/4873* (2013.01); *E01C 19/23* (2013.01); *E01C 19/48* (2013.01); *E01C 19/43* (2013.01)

(58) Field of Classification Search
CPC ..... E01C 19/48; E01C 19/4873; E01C 19/43; E01C 19/238; E01C 19/488; E01C 19/23
See application file for complete search history.

(56) References Cited

U.S. PATENT DOCUMENTS 1,038,732 A * 9/1912 Dunham ..... A01B 29/02 172/350
3,986,782 A * 10/1976 Durham ..... E01C 19/238 404/85
4,507,015 A * 3/1985 Furukawa ..... E01C 13/065 404/101
5,213,442 A * 5/1993 Sovik ..... E01C 7/187 404/102
5,549,412 A * 8/1996 Malone ..... E01C 19/004 404/84.1
5,735,634 A 4/1998 Ulrich et al.
5,752,783 A * 5/1998 Malone ..... E01C 19/006 404/104
5,879,104 A 3/1999 Ulrich
5,971,656 A * 10/1999 Kitsmiller ..... E01C 19/488 249/4
6,027,282 A * 2/2000 Horn ..... E01C 19/48 404/75
6,238,135 B1 5/2001 Rower
6,467,992 B1 * 10/2002 Dietrich ..... E01C 19/48 404/101
6,749,364 B1 * 6/2004 Baker ..... E01C 19/288 404/118

(Continued)

FOREIGN PATENT DOCUMENTS

DE 2212625 9/1973
DE 29514231 10/1995
JP 4565039 10/2010

*Primary Examiner* — Abigail A Risic
(74) *Attorney, Agent, or Firm* — Oblon, McClelland, Maier & Neustadt

(57) ABSTRACT

An oscillation assembly for a paving machine includes an arcuate member for contacting a recently formed asphalt mat laid by a screed assembly of the paving machine. The arcuate member is adapted to oscillate about an axis extending generally horizontally and substantially perpendicular to a direction of travel of the paving machine. The oscillation assembly further includes a drive assembly for powering an oscillation of the arcuate member. The drive assembly includes a drive motor and a linkage coupling the drive motor to the arcuate member.

19 Claims, 2 Drawing Sheets

(56) References Cited

U.S. PATENT DOCUMENTS

| | | | | |
|---|---|---|---|---|
| 9,476,169 | B1 * | 10/2016 | Knapp | E01C 19/41 |
| 9,534,349 | B2 * | 1/2017 | Horn | E01C 23/01 |
| 2017/0159250 | A1 | 6/2017 | Maeyama et al. | |

* cited by examiner

OSCILLATION ASSEMBLY FOR A PAVING MACHINE

TECHNICAL FIELD

The present disclosure generally relates to a paving machine, and more particularly, to an oscillation assembly for smoothening and initial compaction on a recently formed asphalt mat laid by a screed assembly of the paving machine.

BACKGROUND

Paving machines are well known in the art to apply paving mixtures, such as a hot asphaltic bituminous concrete paving material, to a surface of a roadway. Paving machines typically have hopper at a front of the paving machine, a conveyor which extends from the hopper to a rear of the paving machine, an augur at a discharge end of the conveyor for spreading the paving material on the surface, and a screed assembly for smoothening the paving material to form an asphalt mat on the surface. However, in certain scenarios, the surface texture and smoothness of the asphalt mat laid by the screed assembly may be less than optimal, which in turn affects a durability of the asphalt mat.

German Utility Model No. 29514231 relates to a paver for a concrete pavement having a smoothening device disposed at a rear of a screed of the paver. The smoothing device includes one or more trowels rotating about a vertical axis perpendicular to the concrete pavement for smoothing the concrete laid by the screed.

SUMMARY

In one aspect, the disclosure is directed towards an oscillation assembly for a paving machine. The oscillation assembly includes an arcuate member for contacting a recently formed asphalt mat laid by a screed assembly of the paving machine. The arcuate member is adapted to oscillate about an axis extending generally horizontally and substantially perpendicular to a direction of travel of the paving machine. The oscillation assembly further includes a drive assembly for powering an oscillation of the arcuate member. The drive assembly includes a drive motor and a linkage coupling the drive motor to the arcuate member.

In another aspect, the disclosure relates to a paving machine. The paving machine includes a screed assembly configured to lay an asphalt mat on a surface, and an oscillation assembly mounted at a rear end of the screed assembly. The oscillation assembly includes an arcuate member for contacting a recently formed asphalt mat. The arcuate member is adapted to oscillate about an axis extending generally horizontally and substantially perpendicular to a direction of travel of the paving machine. The oscillation assembly further includes a drive assembly for powering an oscillation of the arcuate member. The drive assembly includes a drive motor and a linkage coupling the drive motor to the arcuate member.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
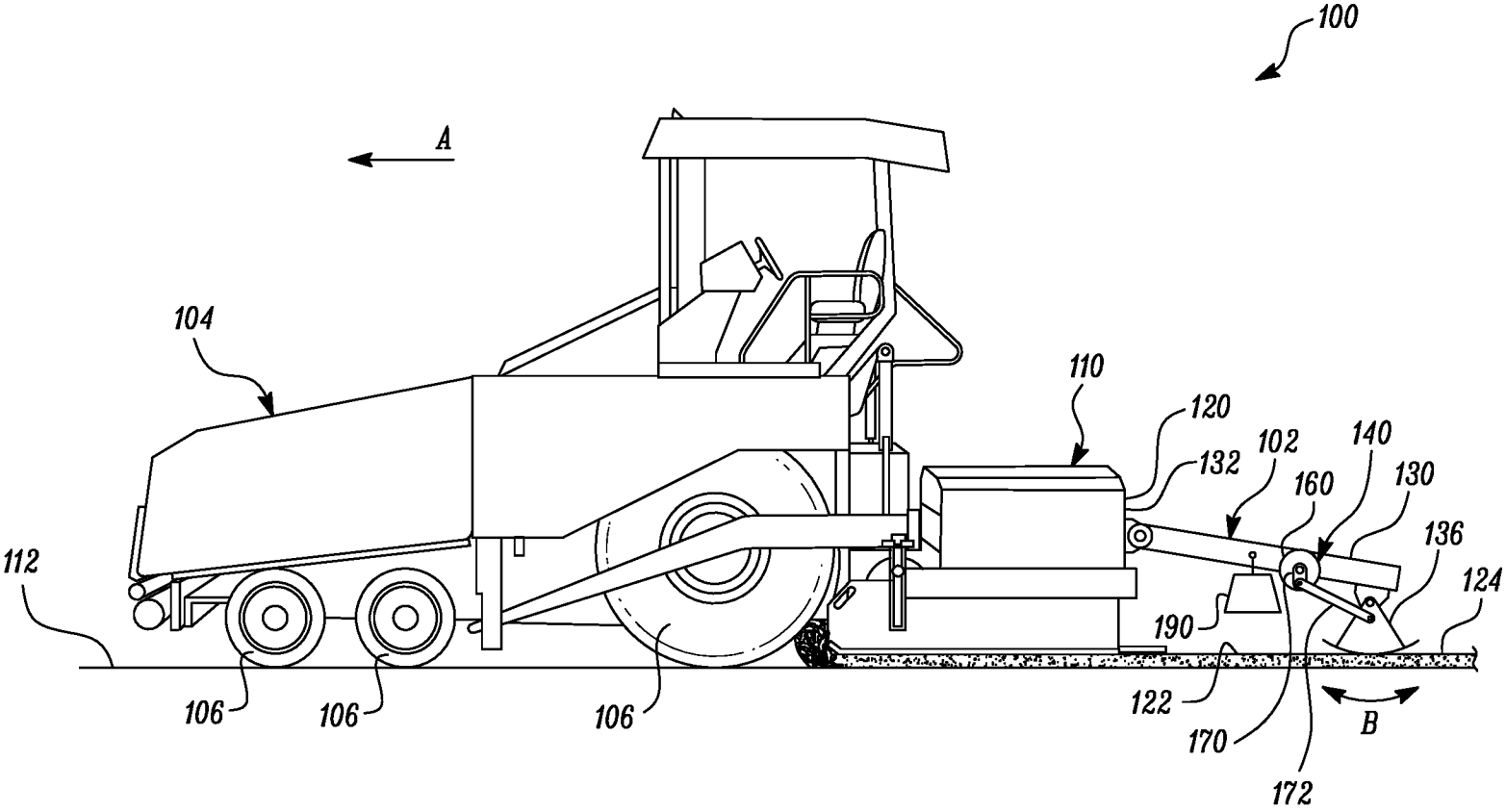
FIG. 1 is an exemplary paving machine including an oscillation assembly, in accordance with an embodiment of the present disclosure.

Referring to FIG. 1 an exemplary paving machine 100 incorporating an exemplary oscillation assembly 102 is illustrated. The paving machine 100 includes a hopper 104, one or more traction devices 106, and a screed assembly 110. The hopper 104 may include a conveyor system having an auger (not shown) that feeds a paving material from the hopper 104 to the surface 112 through a passage in the hopper 104. The hopper 104 may be loaded with any known paving material, such as asphalt. Once the hopper 104 is loaded with the paving material, the paving material may be conveyed to the surface 112.

Traction devices 106 may be powered by any suitable power source, such as an engine, and may be used to propel the paving machine 100 along the surface 112 to be paved. Traction devices 106 may include, for example, a plurality of wheels or a track system. The screed assembly 110 may be used to smoothen the paving material applied to the surface 112, and may include a generally flat surface running substantially perpendicular to a travel direction 'A' of the paving machine 100 to form a mat 122, such as an asphalt mat 124. Screed assembly 110 may be adjustable in various ways to properly smoothen the paving material as it is applied to the surface 112. For example, the screed assembly 110 may be adjusted for height, angle, temperature, and/or vibration.

Figure 2:
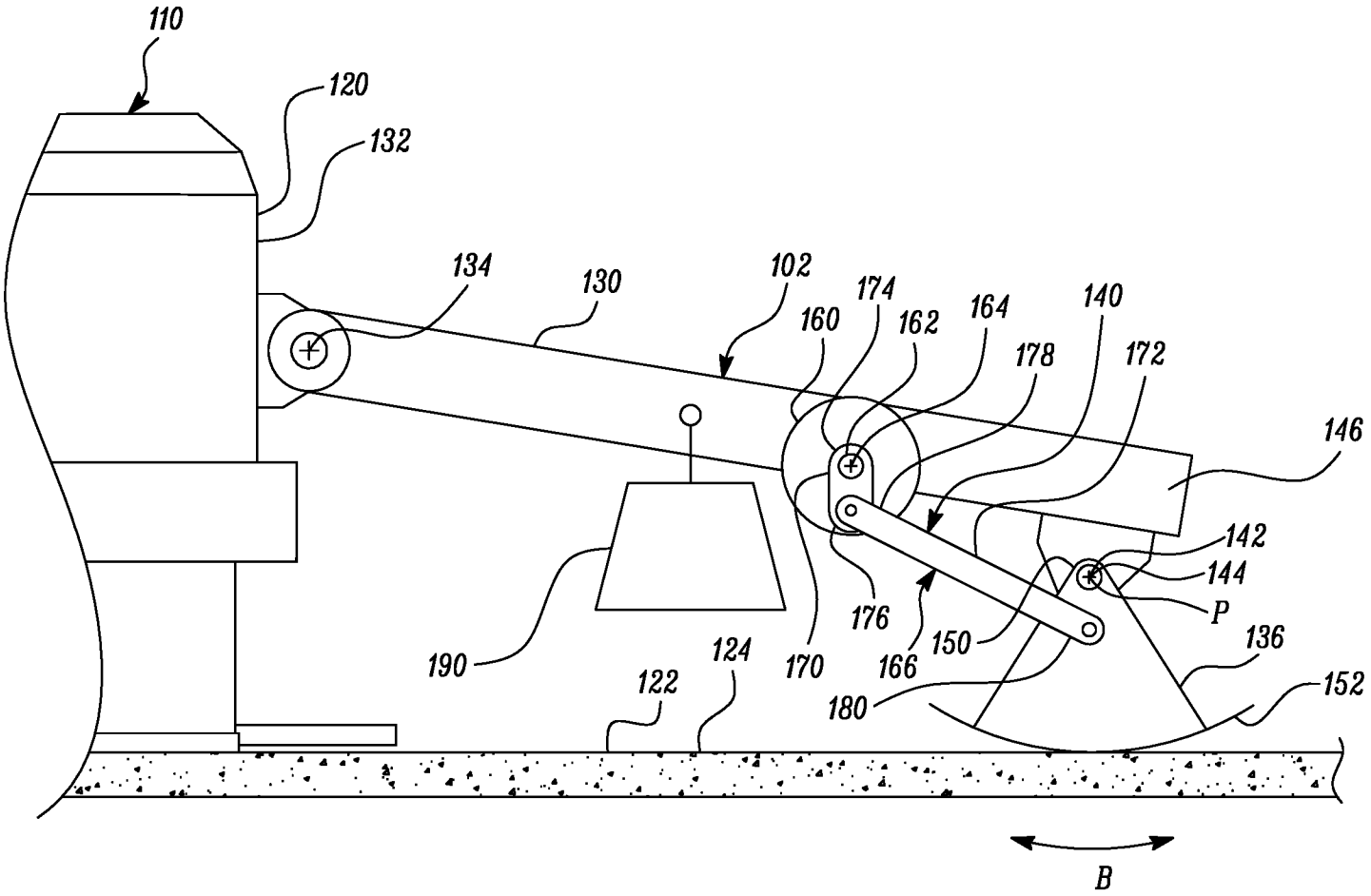
FIG. 2 is an enlarged view of the oscillation assembly of FIG. 1, in accordance with an embodiment of the present disclosure.

Referring to FIG. 1 and FIG. 2, the oscillation assembly 102 is disposed at a rear of the paving machine 100, for example, at a rear end 120 of the screed assembly 110, for smoothing the mat 122, for example, the asphalt mat 124, laid by the screed assembly 110. In an embodiment, the oscillation assembly 102 is pivotally coupled to the screed assembly 110. To facilitate a connection of the oscillation assembly 102 to the screed assembly 110, the oscillation assembly 102 may include an arm 130 that is pivotally coupled to a rear end 120 of the screed assembly 110 (e.g., to a frame 132 of the screed assembly 110). The arm 130 may pivot about a pivot axis 134 relative to the frame 132. The pivot axis 134 is substantially parallel to the surface 112 or the mat 122 and is substantially perpendicular to the travel direction 'A'. The phrase 'pivot axis 134 is substantially parallel to the surface 112 or the mat 122' means that an angle between the pivot axis 134 and the surface 112 or the mat 122 may be in range of −5 degrees to +5 degrees. The phrase 'pivot axis 134 is substantially perpendicular to the travel direction 'A'' means that an angle between the pivot axis 134 and the travel direction 'A' is anywhere between 85 degrees to 95 degrees.

The oscillation assembly 102 further includes an arcuate member 136 for contacting the asphalt mat 124 laid by the screed assembly 110, and a drive assembly 140 for powering an oscillation (see oscillation direction T', FIG. 2) of the arcuate member 136 about an axis 142 for smoothing the asphalt mat 124 laid by the screed assembly 110. The arcuate member 136 may be pivotally coupled to a free end 146 of the arm 130, and may be configured to pivot relative to the arm 130 about a pivot axis 144 of the arcuate member 136. The pivot axis 144 is the axis 142 of oscillation of the arcuate member 136. The axis 142 extends generally horizontally, i.e., parallel, to the mat 122 or surface 112. The phrase 'the axis 142 extends generally horizontally, i.e., parallel, to the mat 122 or surface 112' means that an angle between the axis 142 and the mat 122 or surface 112 may be in range of −5 degrees to +5 degrees. The axis 142 also extends substantially perpendicularly to the travel direction 'A' of the paving machine 100. The phrase 'the axis 142 extends substantially perpendicular to the travel direction 'A'' means that an angle between the axis 142 and the travel direction 'A' is anywhere between 85 degrees to 95 degrees.

In an exemplary embodiment, the arcuate member 136 is a sector of a circular disc and includes an apex 150 and an outer surface 152 disposed opposite to the apex 150. The outer surface 152 of the arcuate member 136 contacts the mat 122 and smoothens the mat 122 as the arcuate member 136 oscillates about the axis 142. A pivot location of the arcuate member 136 may be proximate to the apex 150 relative to the outer surface 152. In an embodiment, the arcuate member 136 may extend along an entire length of the screed assembly 110.

The drive assembly 140 includes a drive motor 160 for providing power to move (i.e., to oscillate about the axis 142) the arcuate member 136. In an embodiment, the drive motor 160 may be a hydraulic motor or an electric motor. In certain implementations, the drive motor 160 may be mounted on the arm 130 and includes a drive shaft 162 that is configured to rotate about a rotational axis 164. In an embodiment, the rotational axis 164 is parallel to the axis 142. The drive assembly 140 further includes a linkage 166 for coupling the drive shaft 162 (i.e., the drive motor 160) to the arcuate member 136, and converting a rotational movement of the drive shaft 162 (i.e., the drive motor 160) to an oscillational movement of the arcuate member 136.

In an exemplary embodiment, the linkage 166 may include a first member 170 and a second member 172. The first member 170 is mounted/connected to the drive shaft 162 and rotates with the drive shaft 162 about the rotational axis 164 of the drive shaft 162. The first member 170 may be an elongated linear member having a first end 174 coupled with the drive shaft 162 and a second end 176 is coupled to the second member 172. Although the first member 170 is contemplated as the elongated linear member, it may be appreciated that first member 170 may be an eccentric member known in the art. The second end 176 of the first member 170 is coupled to a first end 178 of the second member 172. In an embodiment, the second member 172 may be pivotally coupled to the first member 170 and may be configured to move along with the movement of the first member 170. The second member 172 may be an elongated member and a second end 180 of the second member 172 may be coupled to the arcuate member 136. In an embodiment, the second member 172 is coupled to the arcuate member 136 at a location that is offset from a pivot 'P' (defined by the pivot axis 144) of the arcuate member 136 with the arm 130. Thus, the second member 172 is coupled to the arcuate member 136 at a location that is offset from the axis 142. In certain implementations, the first member 170 may be omitted. In such a case, the second member 172 may be coupled to the drive shaft 162 at a location offset from the rotational axis 164 of the drive shaft 162.

Additionally, or optionally, the oscillation assembly 102 may include one or more dead weights 190 attached to the arm 130 for providing additional compression force on the asphalt mat 124 by the arcuate member 136. In an embodiment, the number of dead weights attached to the arm 130 may be based on the desired compression or smoothening of the recently formed asphalt mat 124 laid by the screed assembly 110. It may be appreciated that a total mass of the dead weights 190 can be changed by an operator of the paving machine 100.

Further, in some embodiments, the oscillation assembly 102 may also include an actuator (not shown) for raising or lowering the arcuate member 136 relative to the mat 122 by pivoting the arm 130 relative to the frame 132. For example, it may be desirable to lift the arcuate member 136 off the mat 122 when the paving machine 100 is travelling without performing a paving operation. To do so, the actuator may move the arm 130 to a storage position such that the arcuate member 136 is lifted and maintains a distance from the asphalt mat 124. In an embodiment, the actuator may be a fluid cylinder coupled to the frame 132 and the arm 130. Further, although a single arcuate member 136 extending along an entire length of the screed assembly 110 is contemplated, it may be appreciated that there may be multiple arcuate members arrayed along the length of the screed assembly 110. In certain scenarios, there may more than two arrays, each having multiple arcuate members. In such cases, it may be appreciated that each arcuate member may have a separate drive assembly or a common drive assembly.

INDUSTRIAL APPLICABILITY

During operation, the paving material is conveyed from the hopper 104 by the conveyor and is discharged ahead of a front end of the screed assembly 110. As the paving machine 100 travels in the travel direction 'A', the screed assembly 110 moves over the recently laid paving material, and flattens the paving material over the surface 112, thus laying and forming the asphalt mat 124 on the surface 112. Further, in certain scenarios, the asphalt mat 124 laid by the screed assembly 110 may include bumps. To remove the bumps and smoothen the recently formed asphalt mat 124 laid by the screed assembly 110, an operator of the paving machine 100 may actuate the oscillation assembly 102. The operator may actuate the oscillation assembly 102 by actuating or starting the drive motor 160. In an embodiment, a controller (not shown) may actuate or start the drive motor 160 based on a detection of a formation of the asphalt mat 124 (or bumps on the asphalt mat 124) by the screed assembly 110.

As the drive motor 160 is started or actuated, the drive shaft 162 starts rotating about the rotational axis 164, which in turn causes a rotation of the first member 170 about the rotational axis 164. A rotational movement of the first member 170 causes a movement of the second member 172. As the second member 172 is connected to the arcuate member 136, the movement of the second member 172 causes an oscillation of the arcuate member 136 about the axis 142. Due to oscillation or reciprocation of the arcuate member 136 about the axis 142, and upon a contact of the arcuate member 136 with the asphalt mat 124, the asphalt mat 124 is compressed/compacted, removing any bumps present on the asphalt mat 124. In an embodiment, the operator or the controller may vary a speed of the drive motor 160 based on a travelling speed of the paving machine 100. The speed of drive motor 160 is varied to achieve a desired smoothening of the asphalt mat 124. In this manner, the oscillation assembly 102 of the present disclosure facilitates a removal of the bumps from a recently formed asphalt mat 124 laid by the screed assembly 110, and therefore facilitates a smoothening and an initial compaction of the recently formed asphalt mat 124 laid by the screed assembly 110 to a desired level.

What is claimed is:

1. An oscillation assembly for a paving machine, the oscillation assembly comprising:

an arcuate member configured to contact a recently formed asphalt mat laid by a screed assembly of the paving machine when the paving machine is in operation, the arcuate member adapted to oscillate about an axis extending generally horizontally and substantially perpendicular to a direction of travel of the paving machine when the paving machine is in operation, such that the arcuate member contacts the recently formed asphalt according to the oscillation thereof about the axis; and a drive assembly configured to power the oscillation of the arcuate member when the paving machine is in operation, the drive assembly including a drive motor and a linkage coupling the drive motor to the arcuate member.

2. The oscillation assembly of claim 1 further including an arm couplable to a rear end of the screed assembly, wherein the arcuate member is pivotably mounted to the arm, wherein the axis is a pivot axis of the arcuate member.

3. The oscillation assembly of claim 1, wherein the drive motor includes a drive shaft and the linkage is coupled to the drive shaft and to the arcuate member at a location offset from the axis.

4. The oscillation assembly of claim 1, wherein the drive motor includes a drive shaft and the linkage includes a first member connected to and rotatable with the drive shaft, and a second member coupled to the first member and the arcuate member, wherein the second member is coupled to the arcuate member at a location offset from the axis.

5. The oscillation assembly of claim 2 further including a dead weight coupled to the arm.

6. The oscillation assembly of claim 1, wherein the linkage is configured to convert a rotational movement of the drive motor into an oscillational movement of the arcuate member.

7. The oscillation assembly of claim 1, wherein a speed of the drive motor is varied based on a travelling speed of the paving machine.

8. A paving machine, comprising:

a screed assembly configured to lay an asphalt mat on a surface; and an oscillation assembly mounted at a rear end of the screed assembly, the oscillation assembly including:

an arcuate member configured to contact a recently formed asphalt mat when the paving machine is performing a paving operation, the arcuate member adapted to oscillate about an axis extending generally horizontally and substantially perpendicular to a direction of travel of the paving machine when the paving machine is performing the paving operation, such that the arcuate member contacts the recently formed asphalt according to the oscillation thereof about the axis; and a drive assembly configured to power the oscillation of the arcuate member when the paving machine is performing the paving operation, the drive assembly including a drive motor and a linkage coupling the drive motor to the arcuate member.

9. The paving machine claim 8 further including an arm pivotally coupled to the rear end of the screed assembly, wherein the arcuate member is pivotably mounted to the arm, wherein the axis is a pivot axis of the arcuate member.

10. The paving machine claim 8, wherein the drive motor includes a drive shaft and the linkage is coupled to the drive shaft and to the arcuate member at a location offset from the axis.

11. The paving machine claim 8, wherein the drive motor includes a drive shaft and the linkage includes a first member connected to and rotatable with the drive shaft, and a second member coupled to the first member and the arcuate member, wherein the second member is coupled to the arcuate member at a location offset from the axis.

12. The paving machine claim 9, wherein the oscillation assembly further includes a dead weight coupled to the arm.

13. The paving machine claim 8, wherein the linkage is configured to convert a rotational movement of the drive motor into an oscillational movement of the arcuate member.

14. The paving machine claim 8, wherein a speed of the drive motor is varied based on a travelling speed of the paving machine.

15. The oscillation assembly of claim 1, wherein the drive assembly powers or depowers the oscillation of the arcuate member when the paving machine is in operation responsive to a detection of the recently formed asphalt mat.

16. The oscillation assembly of claim 1, wherein the drive assembly powers or depowers the oscillation of the arcuate member when the paving machine is in operation responsive to a detection of bumps on the recently formed asphalt mat.

17. The oscillation assembly of claim 1, wherein the arcuate member is configured to contact the recently formed asphalt mat when the paving machine is moving in the direction of travel.

18. The paving machine claim 8, wherein the drive assembly powers or depowers the oscillation of the arcuate member when the paving machine is performing the paving operation.

19. The paving machine claim 8, wherein the drive assembly powers or depowers the oscillation of the arcuate member when the paving machine is performing the paving operation.

* * * * *